US005203805A

United States Patent [19]

Cairns

[11] Patent Number: 5,203,805

[45] Date of Patent: Apr. 20, 1993

[54] UNDERWATER ELECTRICAL CONNECTOR

[76] Inventor: James L. Cairns, 2348 Kentucky Ave., Mims, Fla. 32754

[21] Appl. No.: 754,355

[22] Filed: Aug. 29, 1991

Related U.S. Application Data

[63] Continuation of Ser. No. 487,584, Mar. 2, 1990, abandoned.

[51] Int. Cl.[5] ..... H01R 4/60

[52] U.S. Cl. ..... 439/199; 439/201; 439/271

[58] Field of Search ..... 439/190–199, 439/206, 271, 140, 624, 271, 278, 283

[56] References Cited

U.S. PATENT DOCUMENTS

| | | | |
|---|---|---|---|
| 4,142,770 | 3/1979 | Butler, Jr. et al. | 439/140 |
| 4,589,717 | 5/1986 | Pottier et al. | 439/190 |
| 4,795,359 | 1/1989 | Alcock et al. | 439/201 |
| 4,810,202 | 3/1989 | Nodfelt | 439/205 |
| 4,859,196 | 8/1989 | Durando | 439/197 |

*Primary Examiner*—David L. Pirlot
*Attorney, Agent, or Firm*—Brown, Martin, Haller & McClain

[57] ABSTRACT

An underwater electrical connector of the plug and receptacle type intended for use in environments characterized in having high or variable pressures, including a fluid-filled bladder that contains the receptacle and has a single port or a plurality of ports for receiving electrical probes. The chamber has a movable dielectric stopper and the ports comprise a seal having radially constricting force that forms a pressure-tight seal on the stopper. The probe is inserted into the seal, pushing the stopper to a retracted position with the seal forming a pressure-tight seal on the probe. The chamber has a plurality of innerconnecting dielectric bath chambers with a wiping seal positioned therebetween, for bathing and wiping the stopper and the probe as the probe moves against the stopper to the electrical contact position. This also provides a single chamber with two wipers. The bath chambers comprise a single chamber with fluid flow therethrough to replenish and condition the dielectric fluid in the respective bath chambers. This fluid flow is around the stopper or through channels within the stopper. An electrical connection of more than two circuits is provided by a single probe in a manner that insures the integrity of the electrical connection while reducing or eliminating damage to seals and the receptacle connectors through movement of a multiple contact probe.

4 Claims, 6 Drawing Sheets

UNDERWATER ELECTRICAL CONNECTOR

This is a continuation of U.S. patent application Ser. No. 07/487,584, filed Mar. 2, 1990 now abandoned.

BACKGROUND OF THE INVENTION

The invention concerns underwater electrical connectors, and more particularly concerns underwater connectors which use bladder assemblies to shield connector contact surfaces from contamination by the high-pressure salt water environment in which the connector is used.

The Inventor has pioneered the use of flexible, fluid-filled bladders with self-sealing ports to protect contact surfaces in underwater connectors. The genesis of this significant development in undersea connector technology is found in the Inventor's U.S. Pat. Nos. 3,643,207; 4,085,993; and 4,606,603. Essentially, these patents teach the use of a flexible, fluid-filled chamber in a connector for pressure equalization between a protective environment internal to the bladder in which connector contact surfaces are disposed, and the high-pressure corrosive sea water environment of the deep ocean in which the connector is deployed. An electrical (or optical) pathway is completed by insertion of a contact-carrying male probe through a reclosable end seal integral with the bladder. When the probe extends through the end seal, a barrier between the interior of the bladder and the outside environment results from the pressure of the end seal material against the probe. When the probe is withdrawn, the barrier must be maintained. The inventor has found that environmental sealing cannot rely solely on the compression of the end seal material, because the material, "forgets" to close, especially when mated to a probe for a long period of time in cold ocean water. This reluctance to close results in the leakage of fluid from the interior of the bladder, and the leakage of outside water into the bladder. Since the connecting surfaces within the bladder (in the form of sockets) are contained within the common chamber formed by the bladder, entry of water into the bladder poses the risk of conductive path formation between multiple sockets.

A significant developmental stage in the progress of the fluid-filled bladder technology was reached with design of a coaxial connector having a long, sturdy male probe in a holder, which supported multiple conductive paths. In addition, in the bladder, the end seal operation was enhanced by use of annular constricting elements for each passage through the end seal. The constrictive elements wiped a probe clean as it entered and held tightly against it while inserted; however, under situations of demating after long mating times and low temperatures, the improved end seal would close slowly, allowing an exchange of fluid for sea water between the bladder and the surrounding ocean environment. Furthermore, addition of the constricting elements resulted in high insertion forces, because the male probe had to struggle mechanically against them to penetrate the passages closed by the end seal. Withdrawal of a probe was resisted by high withdrawal forces produced by the additional constricting elements acting against the probe. If the connector was mated for any length of time, the rubber material of the end seal would be held very tightly against the probe by the constricting elements, thereby causing it to conform on a microscopic basis to the irregularities on the surface of the probe and making withdrawal difficult, at best.

The invention laid out in the description to follow advances the fluid-filled bladder technology for submersible connectors by reducing the high insertion and withdrawal forces at the last stage of technology development.

In addition, the present invention provides multiple, fluid-innerconnecting, dielectric bath chambers which provide intermediate wiping of the movable stopper and the insertable probe, as they move within the fluid filled bladder, thus providing increased environmental isolation in making electrical connections in underwater environments.

The inventor further provides a single dielectric chamber having two wipers.

The invention described is meant for practice primarily in the undersea environment, where the threats of corrosion, pressure, and low temperature significantly affect the operation of connectors. However, the inventor contemplates the use of his invention in other contexts; for example, in explosive environments such as are encountered in granaries, mines, or fuel farms.

The principal objective of the described invention is to provide a new and improved underwater or submersible connector utilizing a dielectric, fluid-filled bladder containing one or more sockets and having an end seal through which a probe or probes are inserted for connection with the sockets, the connector providing an improved, highly reliable barrier against the threats posed by the undersea environment.

A further objective is to provide such a new and improved connector with the ability to be connected with a minimum of insertion force and disconnected with a minimum of extraction force while deployed undersea.

A further improvement of the invented connector is the multiple, interconnected, dielectric bath chambers, with an internal wiper positioned between the chambers, that further restricts the entry of sea water or impurities into the part of the bladder containing the electrical receptacles.

Additionally, the new and improved connector permits the underwater connection of multiple, separate electrical circuits through one, sealed electrical connector.

SUMMARY OF THE INVENTION

The invention is based upon the realization and use by the inventor of a movable stopper, operating within the fluid filled bladder environment of the connector, to protrude through the end seal port through which the connector probe is inserted, to maintain the pressure seal protection of the interior of the bladder without the need for the constricting elements of the prior art. So when the probe is inserted, and the stopper is moved by the probe to a retracted position, the probe then provides the seal.

In this embodiment, the inventor has determined that the sealing of the bladder can be improved by further providing innerconnecting multiple dielectric bath chambers, having an inner wiper spaced therebetween, to further restrict the passage of sea water and other impurities into the receptacle chamber, with the retracted movement of the stopper and the insertion of the probe. The innerconnecting of the multiple bath chambers provides dielectric fluid flow therebetween, to assure the supply and the serviceability of the dielectric fluid in each of the chambers. This permits dielectric fluid to bathe and yet be wiped from the passing stopper or probe, to aid in removing, diluting or isolating sea water or impurities that may get through the restricted opening in making an electrical connection, with a dielectric fluid bath that has not been unreasonably diluted by outside sea water or other impurities.

Further, the invention further provides a unique communication of dielectric fluid between the respective dielectric bath chambers. This is done in a manner that restricts the fluid flow therebetween to a degree that total penetration by sea water of the dielectric bath chamber closest to the sealed opening, will only have a restricted fluid intermingling with the dielectric fluid as a whole, and particularly the main body of the dielectric fluid in the second or other dielectric fluid bath chambers.

The invention also recognizes that it is very desirable in many instances to make connections of multiple electrical circuits through a single connection, which is made possible in this invention by the unique use of multiple electrical receptacles in the chamber and multiple electrical contacts on the probe. These multiple, electrical innerconnections employ a plurality of electrical contact bands through which the probe passes. The contact bands have inward projections that make an electrical connection with contacts on the probe. The multiple contacts on the probe do not have to project above the general surface of the probe, thus making a smooth probe. This removes the problem of prior art probes that have an uneven surface, which when the probe passes through the constricted end seal, damages the seal which over a period of time can result in excessive sea water or other impurities being passed into the chamber's bladder.

The summarized invention, therefore, achieves the objectives of using the lower insertion and extraction forces by provision of the stopper in the electrical socket assembly, and further increases the environmental isolation of each socket assembly by providing multiple, dielectric, fluid filled chamber baths, having an internal wiper positioned therebetween, and which fluid baths have inner fluid communication for maintaining the integrity of the dielectric fluid in cleaning or diluting impurities that may be on the stopper or probe that moves therethrough, and additionally the provision of making multiple electric circuit connections through use of a single socket assembly having a single intrusion probe connection.

The achievement of these and other objects and advantages by the invented connector will be better understood when the detailed description of the invention, given below, is read with reference to the next-summarized illustrations, in which.

DETAILED DESCRIPTION OF THE PREFERRED EMBODIMENTS

Figure 1:
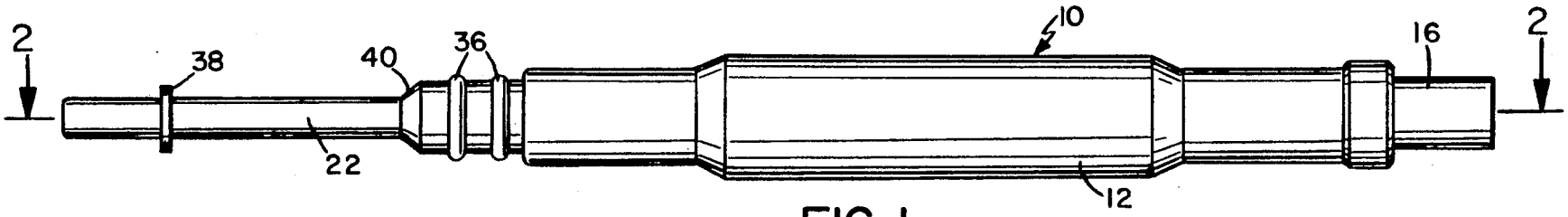
FIG. 1 is a side elevation view of an electrical socket assembly.

FIGS. 1-5 illustrate, in various levels of detail, the structure and operation of an electrical socket assembly which is used in the invention. The electrical socket assembly 10 includes an outer module 12 made of a flexible, elastic, nonconductive material, such as a natural or synthetic rubber. The module 12 essentially forms a bladder, or chamber, within which an electrical socket structure is disposed. An end seal 14 is formed in the module for sealing the back end of the module. An entry lip seal 16 is formed in the forward end of the module. The module 12 is essentially cylindrical in shape, with both of the seals 14 and 16 consisting of annual structures, each pierced through with a passageway opening into the module 12. The material from which the module 12 is formed is elastic so that the seals 14 and 16 radially constrict against objects inserted into their respective passageways to form therewith respective barriers resistant to fluid and pressure. A dielectric fluid 18 fills the interior of the module 12. The fluid 18 has the same characteristics as the fluid which fills the bladders of the Inventor's cited U.S. Patents, and is used for the same purposes. A movable dielectric stopper 20 has a forward extension, or tip 21, which extends through the passageway formed in the entry lip seal 16. The stopper 20 is free to slide within the module 12. The radially constrictive force exerted by the lip seal 16 through the passageway seals the lip seal 16 against the stopper tip 21 to form a fluid and pressure resistant barrier. The barrier prevents the transfer of fluid between the interior and exterior of the module 12.

Chamber 12 has multiple innerconnecting dielectric fluid baths 18, 54 and 31 The stopper 20 in its normal unmated position extends through each of said dielectric bath chambers, and during the mating sequence the stopper moves in said bath chambers to its retracted position as will be described in more detail hereinafter.

The probe 20 has a first end 21 with a diameter slightly larger than the restricted opening of the entry lip 16, to maintain the fluid sealing of the sealed opening to the chamber 12. The midportion or second portion of the stopper 20 has a reduced diameter section 35, which is normally positioned in the passageway 33 of the wiper 41 in the unmated condition. The other end or third portion 49 of the stopper 20, has a diameter comparable to that of end 21, and when unmated is positioned in the second dielectric fluid bath 18, and also extends through the electrical contact 28. So the reduced diameter portion 35 of stopper 20 extends through the wiper passageway, and with portions thereof extending into the first dielectric bath chamber 31 and the second dielectric bath chamber 18 which includes an intermediate bath chamber 54. Thus, the respective bath chambers are fluid innerconnecting, with free flow of dielectric fluid between the main chamber or second bath chamber 18 .through space 51 along the outer side of end 49 of the stopper 20, to bath chamber 54, and through the space in 33 to the first bath chamber 31.

The respective first and second bath chambers 31 and 18, function to capture any sea water that may penetrate past the entry lip on or in contact with the stopper tip 21, in its movement from the extended to the retracted position, and thus its movement through the respective bath chambers. Wiper 41, has a restricted opening 33 that is smaller than the outer diameter of end 21 of stopper 20, thus wiping the stopper end in movement therethrough. The fluid innerconnection further provides insurance of sufficient fluid from the main source 18 to the respective intermediate bath chambers 54 and 31. This allows movement of fluid and replenishment of fluid in the first bath chamber 31, thus minimizing any sea water or other impurities that may not be wiped from the stopper tip 20 or the probe in passing through the entry lip. The wiper 41 functions to restrict any further movement of sea water or impurities from the first bath 31 to the second bath 18 while still allowing innerconnection of the dielectric fluid between the respective baths. This fluid passageway, however, is sufficiently restricted so that if there is a major penetration of sea water through the entry lip, there is a restriction in movement of the sea water from the first bath chamber to the second bath chamber. Also while there is a single chamber, the chamber does have two wipers, namely the entry lip 16 and wiper 41.

Figure 5:
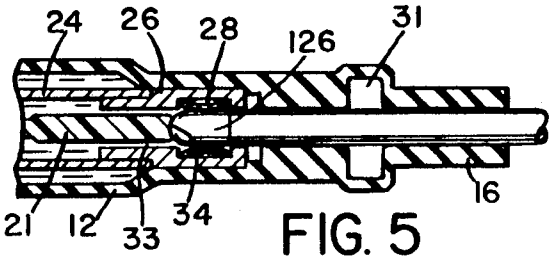
FIG. 5 is a view similar to that of FIG. 4 showing complete insertion and connection of a probe in the electrical socket assembly of FIG. 2.
Figure 4:
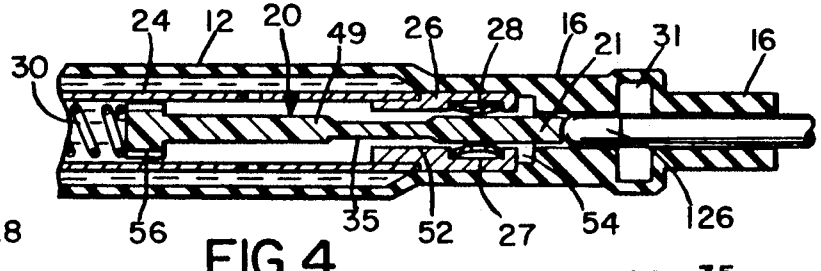
FIG. 4 is a view similar to a portion of FIG. 2, showing partial insertion of a probe into the electrical socket assembly of FIG. 2.

With reference to FIGS. 4 and 5, it will be evident that, as a probe 126 is inserted into the module 12 through the entry lip seal 16, the probe will engage the end of the stopper tip 21, pushing it into a retracted position within the module 12. The probe 126 follows the stopper tip on its trip into the interior of the module 12, thereby replacing the stopper tip 21 in the barrier formed with the entry lip seal 16. When the probe is withdrawn, the stopper tip 21 follows the probe as it leaves the passageway in the entry lip seal 16, and replaces the probe in the barrier formed with the lip seal 16. One will appreciate that the mating and demating of a probe with the electrical socket assembly does not require much expansion of the passageway in the lip seal 16 when the probe is inserted, nor contraction of the passageway when the probe is removed. Since the stopper 20 eliminates the requirement for closing the entry lip seal 16 when the probe is withdrawn, the need for the tightly constricting elements for the prior art bladder assemblies is eliminated, thereby reducing the insertion and extraction forces necessary for mating and demating the electrical socket assembly 10 with a probe. The non-contact of the stopper 20 with the wiper 41 in space 33 in the normal sealing position of stopper 20, further reduces the initial and total force required to force the probe into and through the sealable opening 16.

Returning to FIGS. 1 and 2, electrical conductivity is provided within the socket assembly 10 by a conductive rear piece 22, a cylindrical conductive tube 24, a conductive forward piece 26, and an annular contact band 28. Each of the elements 22, 24, 26, and 28 is made of an electrically conductive material. The rear piece 22 has an annular groove 23 for receiving and sealing to the inner end seal 14 of the module 12, and a forward extension 25 which is received in one of the tube 24. The tube 24 extends between the end piece 22 and the forward piece 26, which fits into the forward end of the tube 24. The forward piece 26 has a forward extension with an interior annular groove 27 in which the annular contact ring 28 is seated. Electrical conductivity is thus provided from the forward end of the module 12, out through the rear end of the module.

A stopper return spring 30 is disposed inside the tube 24 and acts between the forward end of the end piece 22 in the rear end of the stopper 20.

Figure 2:
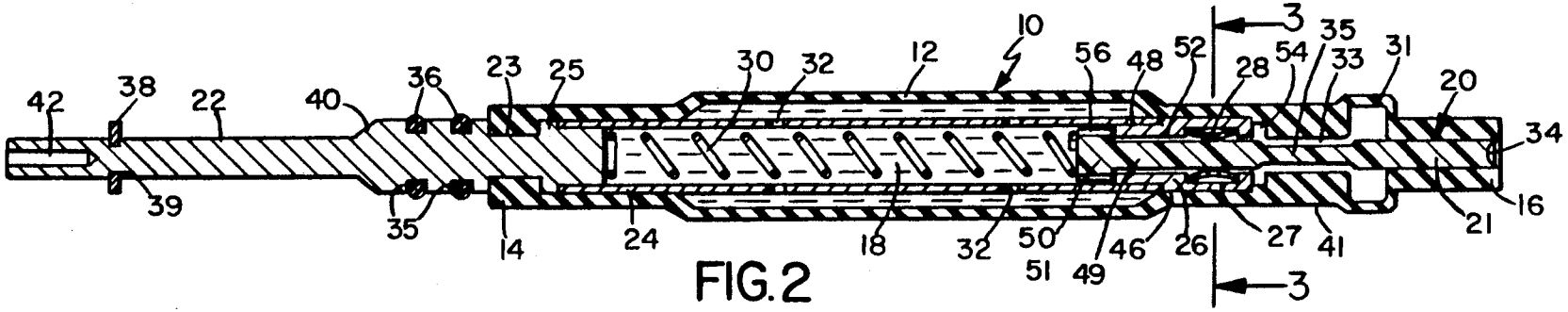
FIG. 2 is a sectional view taken on line 2—2 of FIG. 1.

When a probe is inserted into the electrical socket assembly 10 and moves the stopper 20 rearwardly within the tube 24, the dielectric fluid 18 is displaced somewhat by the rearward motion of the stopper. This results in an expansive deformation of the module 12. As shown in FIG. 2, the fluid 18 is ported through radial holes 32 in the tube 24.

As shown most clearly in FIGS. 2, 4, and 5, the stopper tip 21 engages the end of a probe by means of a concave face 34 in the end of the tip 21. When the stopper 20 is pushed out of place by a probe, the probe enters the forward passageway through the entry lip 16 and engages the contact ring 28 to establish conductivity between the probe and the conduction apparatus in the socket assembly 10. As the probe is inserted through the entry lip seal 16, it pushes the stopper 20 rearwardly in the tube 24, thereby compressing the spring 30. The spring 30 is of such a dimension that the stopper 20 can be pressed into the tube 24 and will be recessed only to the point where the concave face 34 is displaced just to the rear of the annular contact ring 28 within the front piece 26. The bore of the front piece 26 acts as a longitudinal guide for the stopper tip 21, aligning it longitudinally with the passageway through the entry lip seal 16. Of course, when the probe is withdrawn from the passageway in the entry lip seal 16, the spring 30 urges the stopper 20 forward into the breach: the stopper follows the probe, until the probe is completely withdrawn. The spring 30 then continues stopper 20 forward until the large cylindrical seat 50 engages the shoulder 48 of the forward piece 26. The diameter of the cylindrical seat 50 is slightly less than the interior diameter of the tube 24, so that the tube 24 acts as a guide to the seat 50.

Figure 6:
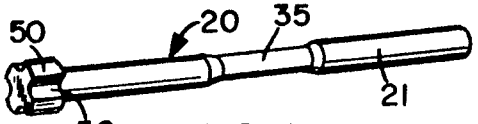
FIG. 6 is a perspective view of the stopper element.
Figure 3:
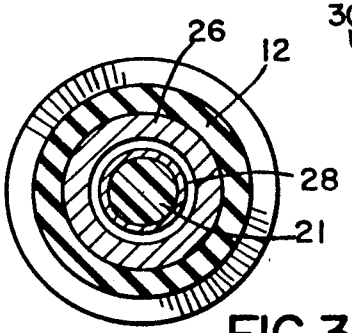
FIG. 3 is an enlarged sectional view taken on line 3—3 of FIG. 2.

As shown in FIGS. 2, 4, and 6, the enlarged cylindrical seat 50 of the stopper 20 is slotted by slots 56, to permit the fluid 18 to flow past the stopper 20 as the stopper is being displaced within the module 12.

As shown in FIGS. 1 and 2, the end-piece 22 includes a pair of annular grooves 35 that provide seats for a pair of O-ring seals 36. The end piece 22 has a tapered transition forming a load-bearing shoulder 40, and a solder pot 42 bored in its furthest tip. A snap-ring 38 is seated in an annular groove 39 formed just forward of the shoulder pot 42 in the outer surface end piece 22.

In summary, then, the structure of the electrical socket assembly illustrated in FIGS. 1-6, provides a protected environment for a contact surface (the ring or band 28), which is entered through an end seal 16. The stopper 20 ensures that the end seal 16 never has to close completely to a zero-diameter hole when a probe is withdrawn from it. The entry lip seal 16 acts against the stopper tip 21 and a male probe having a slightly larger diameter than the stopper tip. Thus, the entry lip seal 16 is always full of something, either the stopper tip 21, or a probe. There is never a requirement for the lip seal to substantially alter its dimensions. Therefore, only a minimal amount of stretch of the material of the module 12 is required for cycling a probe. The module material is selected to be substantially elastic, so that the entry lip seal 16 is not leaky. However, in the event that additional constrictive elements are required to maintain the integrity of the entry lip seal 16, one can appreciate that the insertion force required to move a probe into the seal 16 will still be substantially less with the arrangement illustrated in FIG. 2 than if the probe were required to open the passageway through the seal from a zero diameter.

The integrity of the seal at the forward end of the electrical socket assembly 10 may be enhanced by a conventional rubber-to-metal bond 46, which can be assisted by an external clamping collar on the outside of the module 12 over the forward piece 26.

In movement of the probe 126 through sealable opening 16, the probe contacts stopper 20 and forces it rearwardly, thus the contact 126 moves through the first dielectric bath chamber 31, that functions to wash away, dilute or remove water or other impurities from the end of probe 126. Probe 126 then passes through the constricted opening of wiper 41 which functions to wipe off any remaining impurities, dielectric fluid, etc., on the probe 126. The stopper 20 is simultaneously forced to the completely retracted position of FIGS. 4 and 5. The inward movement of the probe 126, contacts the forward end 21 of the stopper 20 and pushes it backward. The probe 126 is then wiped by the constricted opening of the entry lip 16, passes through bath 31, and through wiper 41 that provides a circumferential wiping of the end of probe 126, with the probe 126 then passing through bath chamber 54 into bath chamber 18, to make electrical contact with the ring or band electrical receptacle 28. The respective dielectric bath chambers, or the single chamber and the inner wiper 41, function to prevent a conductive path forming between the forward conductive part 26 and the external environment. Such a conductive path can possibly be created by a small scratch through the lip seal caused by sand, or a burr, on a probe, or can be caused by non-smooth surfaces on the probe. Under certain circumstances, the scratches might contain traces of sea water with an electrically—conductive composition. The combination of the two wipers in the single dielectric fluid bath prevents conduction under such circumstances.

Figure 7:
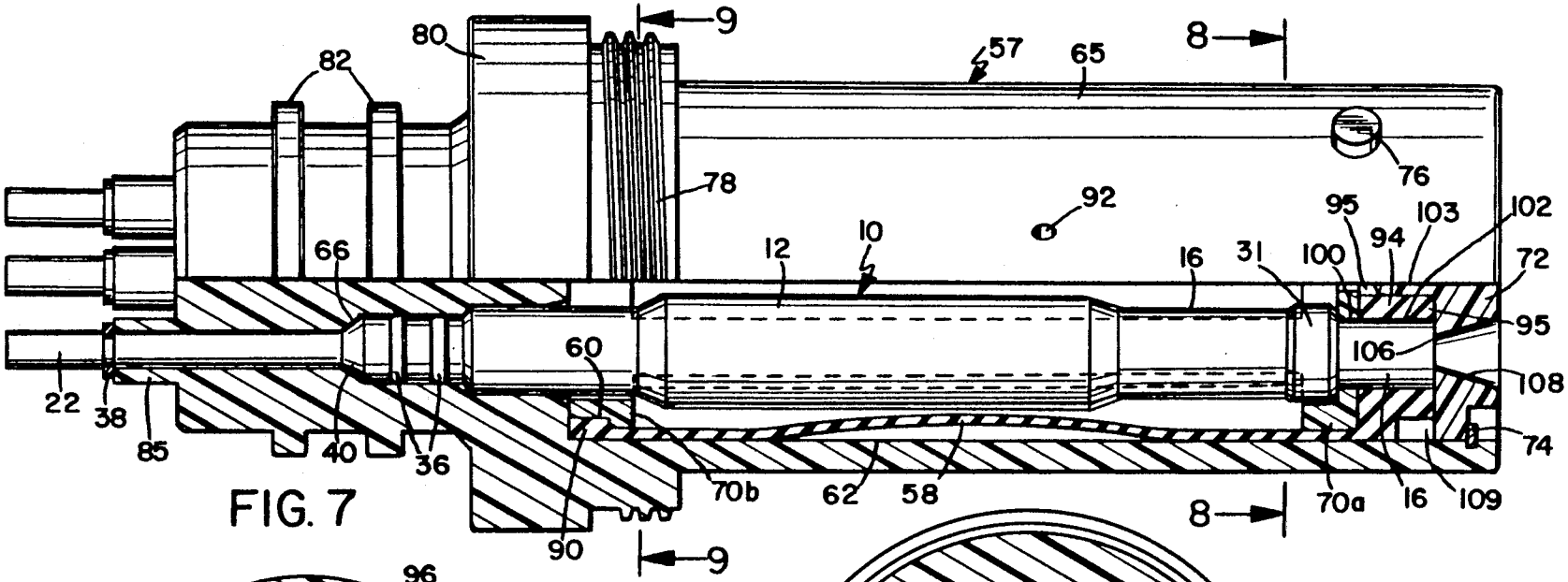
FIG. 7 is a side elevation view, in partial section of a connector receptacle including a plurality of electric socket assemblies.
Figure 9:
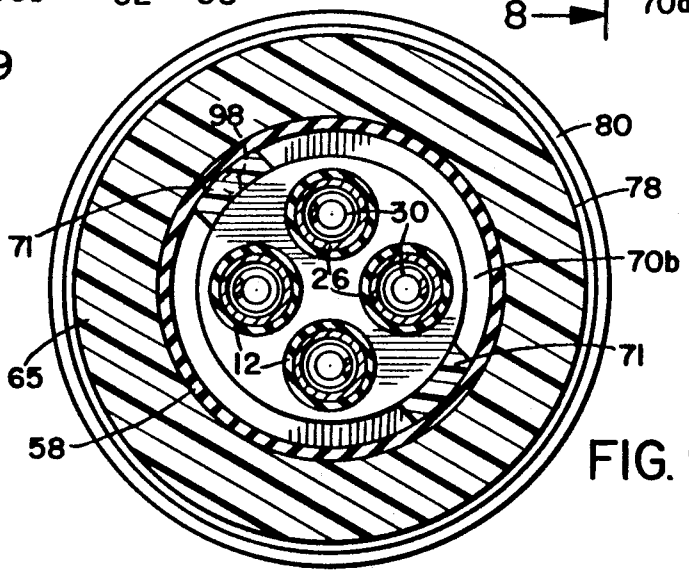
FIG. 9 is a sectional view taken along line 9—9 of FIG. 7.

Referring now to FIGS. 7-11 that show a receptacle for a submersible electrical connector that has a fluid-filled bladder which encloses a plurality of electrical socket assemblies identical with the one illustrated in FIGS. 1-6, and described above. The receptacle illustrated in FIGS. 7, 8, and 9 includes a receptacle shell 57 constructed of non-conductive, high impact plastic or other suitable material enclosing a fluid-filled bladder 58. The receptacle 57 includes an elongate sleeve 65, which is a substantially cylindrical piece having a front portion with four through bores, each bore accepting the end of a respective electrical socket assembly. In the description which follows, it is assumed that the electrical socket assemblies disposed in the receptacle shell 57 are identical to the one illustrated and described above. For convenience, the one socket assembly shown in side elevation in FIG. 7 is assumed to be the electrical socket assembly 10 of FIGS. 1-6.

Continuing the description, the electrical socket assembly 10 is seated in the rear portion of the shell 57 in one of the four through bores provided. The electrical socket assembly 10 is seated by engagement of its load bearing shoulder 40 against a load bearing seat 66 in one of the through bores. The socket assembly 10 is retained in this position by the snap ring 38. The rearmost portion of the rear piece 22, that is, the portion wherein the solder pot 42 is located, projects out from the rear of the shell rear portion.

Figure 10:
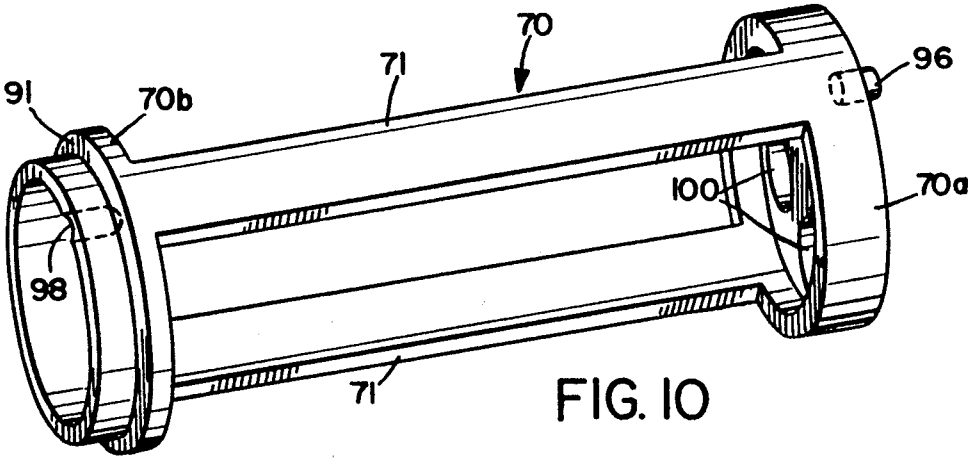
FIG. 10 is a perspective view of the bladder support used in the bladder assembly.

The bladder assembly 58 is formed from a flexible, elastic material such as natural or synthetic rubber; it is maintained in an elongated, cylindrical configuration by a bladder stretcher, or support, 70 (FIGS. 10). As can be seen from FIG. 10, the stretcher essentially consists of a pair of spaced annular portions 70*a* and 70*b* separated by a pair of support spacers 71. The bladder 58, with the stretcher 70 inserted into it, is placed in the interior bore of the receptacle sleeve 65. An end cap 72 (FIGS. 7 and 11) retains the bladder assembly in the receptacle sleeve bore. The end cap 72 is retained by a snap ring 74, at the forward end of the interior bore of the shell 57.

The structure of the receptacle shell 57 includes a mating key 76 on the outer surface of the sleeve 65, mating threads 78 at the bottom of the sleeve 65 and an enlarged-diameter shoulder 80 aft of the threads 78. Grip rings 82 are formed behind the shoulder 80, and boot seal nipples 85 are provided to provide fluid and pressure seals against the rear extensions of the rear pieces in the four electrical socket assemblies disposed in the receptacle 57.

Figure 8:
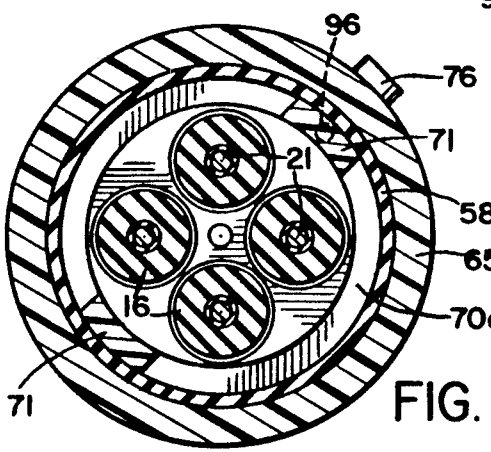
FIG. 8 is a sectional view taken along line 8—8 of FIG. 7.

The structure of the bladder assembly includes a rear seal 90 formed against a rear seal seat 91 in the rear portion 70*b* of the spacer 70. An end seal 94 is formed in the forward end of the bladder assembly. The end seal 94 of the bladder assembly includes four through passageways, or holes 100, that fit around and are secured to the outer surface of end seal or lip 16, with the holes being aligned with four corresponding passageways, or holes 100, on the forward end of the stretcher assembly 70 by means of an end seal alignment key 96 on the stretcher. The alignment key 96 is received in a corresponding keyway 98 of the end seal 94. The alignment key 96 is shown in FIG. 8, and the keyway 98 in FIG. 9. One of the holes 102 in end 94 is shown in FIG. 7 aligned with a corresponding hole 100 in the spacer assembly 70. The end cap 72 is also bored through with four holes 106, which are aligned to the holes 102 of end 94 by an alignment key 104. The alignment key 104 is seated in a corresponding keyway (not shown) in end 94 to orient the holes 106 with the holes 102 in nd 94. As seen in FIG. 7, the end holes 106 of the end cap 72 are tapered at 108. The tapered surface 108 provides for guidance of a probe into the holes 102 in end 94. The end cap 72 is mounted in shell 57 to lightly compress end 94, thereby adding to the radially constricting force that the end applies on the holes 102, around end seal 16.

Figure 11:
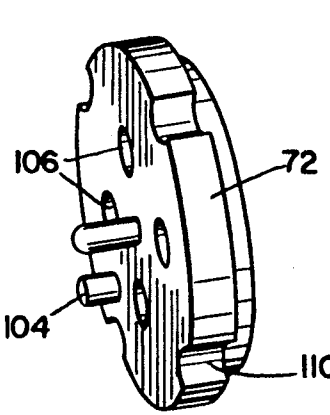
FIG. 11 is a perspective view of the receptacle end cap for retaining the bladder assembly.

An annular void 109 is formed between end 94, the rear of the end cap 72, and the interior surface of the receptacle sleeve 65. The void 109 provides a space for end 94 to slightly deform into, if necessitated by the passage of a probe into end seal 16. The large bladder assembly 58 is filled with the dielectric fluid through hole 95 that is normally sealed by plug 103 on end cap 72. Module 12 (and each of the other three modules in the shell 65) are individually filled through their end opening by depressing stopper 20. The void 109 is vented to the outside environment through grooves 110 in the end cap 72 (FIG. 11).

The exterior surface of the fluid-filled bladder assembly 58 is vented to the outside environment through vent holes 92 in the receptacle shell 65. The venting provides for equalization of the pressure between the outside environment and the interior 62 of the fluid-filled bladder assemblies 58 and 10.

As shown in FIG. 7, the electrical connector assembly 10 is disposed inside the bladder assembly 58 in alignment with an aligned set of holes including a spacer hole 100, an end seal hole 102, and an end cap hole 106. It will be evident that four sets of aligned holes provide a corresponding set of ports opening into the bladder assembly 58. For the respective port illustrated in FIG. 7, the electrical socket assembly is held in the receptacle shell and in the bladder assembly in alignment with the port. The socket assembly 10 is sealed to the surface of opening 102. The socket assembly 10 is held in the receptacle by the snap ring 38, the assembly 10 being aligned with its respective port by the engagement of the shoulder 40 with the seat 66. The O-rings 36 seal the through bore in the rear portion of the receptacle shell to prevent fluid flow between the outside of the shell and the interior of the bladder. The alignment of the socket assembly 10 with the port consisting of the holes 100, 102, and 106 provides for the extension of the stopper tip 21 through the port. This is best shown in FIG. 7. Each of the other three ports (not shown) of the receptacle of FIG. 7 is similarly aligned with a respective socket assembly. It is to be understood that the function of the outer oil bath defined by bladder assembly 58 serves as a secondary environmental seal in case of failure of bladder 12.

Now, one will appreciate that as a probe is inserted into the port illustrated by the cutaway portion of FIG. 7, it contacts the tapered surface 108, and is guided through the opening 106 into the end seal 16, where it contacts the concave face 34 of the stopper tip 21. When the probe engages the concave face 34, it pushes the stopper rearwardly into the socket assembly 10; thus, as the probe is inserted through the end seal 16 into the socket assembly 10, it displaces the stopper tip 21, against force from the spring 30. Also, when the probe is withdrawn from the receptacle port, the stopper tip 21 follows it back through the port. Thus, the end seal 16, being formed of an elastic material which is in compression, exerts a constricting force on the hole in the seal 16. The constricting force closes the hole into a sealing engagement with the stopper tip 21, or with a probe tip 126. As with the forward passageway of the entry lip seal of the socket assembly 10, the end seal hole is never required to compress so far as to close the hole. Since, as described above, the tip of a probe has a slightly larger diameter than the stopper tip 21, the insertion force required to place the probe tip contact with the connector surface inside the socket assembly is minimized. The compression of the end seal 16 also acts to wipe the exterior surface of a probe 126 clean when the probe 126 is inserted into and extracted from the receptacle.

Figure 12:
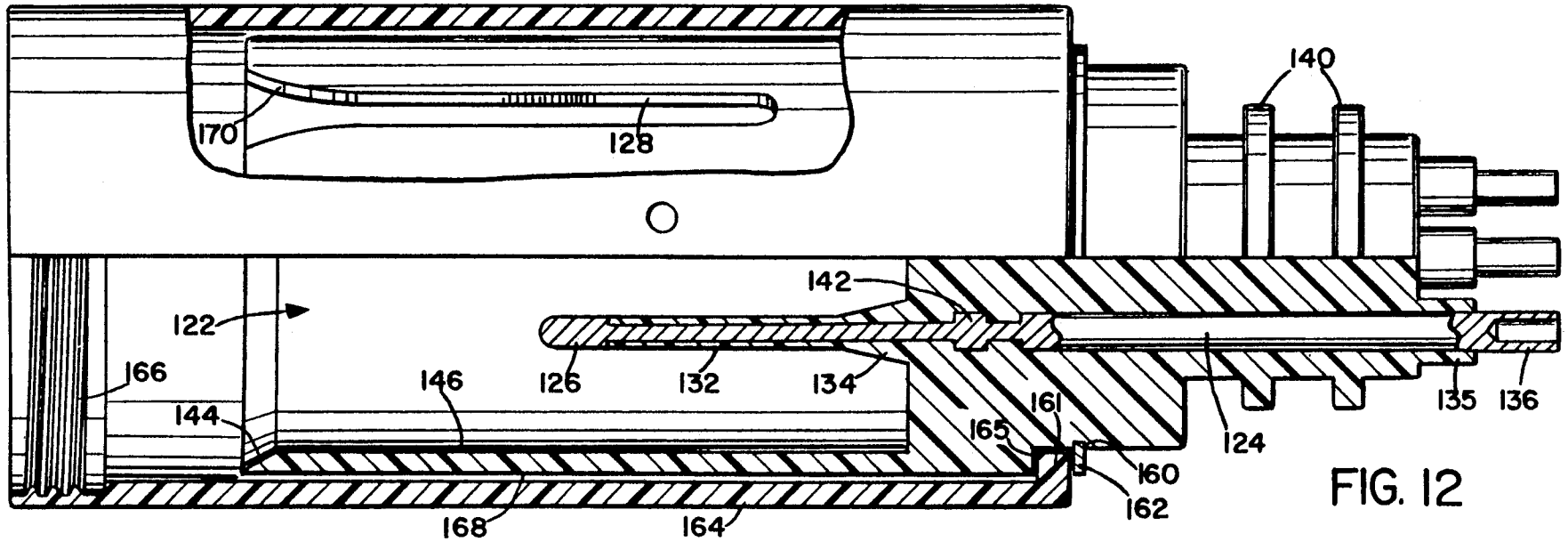
FIG. 12 is a side elevation view, in partial section, of a connector plug including a plurality of electrical probes.

The plug portion of the connector of the invention is illustrated in FIG. 12. For this embodiment, the plug assembly includes a dielectric plug body 122 with four conductive elements, one of which is illustrated and indicated by 124. The conductive element 124 transitions to a conductive tip 126 at its forward end and, at its rearward end, to a solder pot 136. The plug body 122 is formed of a non-conductive material, while the conductive path consisting of the conductive tip 126, and the element 124 is formed of a conductive material, preferably a metal. The end portion of the conductive element 124 may be sealed to attach wires by a boot seal 135 for which the nipples are provided. As illustrated in FIG. 12, construction of the plug body 122 includes formation of a dielectric outer probe shell 132, which tapers at its base 134. The combination of the probe outer shell 132 with a tapered base 134 and the conductive tip 126 forms one of the four probes of the plug in FIG. 12. The other three probes are identical with the probe illustrated in FIG. 12. The tapered base 134 of the probe shell 132 enhances the mechanical reliability of the probe by increasing its strength. Further mechanical enhancement is provided by an enlargement 142 of the conductive element 124. As shown in FIG. 12, the plug body 122 is provided with grip rings 140 for better bonding to cable termination material. The plug body 122 has a mating keyway 128 with a flared entrance 170, which engages the mating key 76 on the receptacle sleeve 65 of FIG. 7. When the plug body is brought together with the receptacle of FIG. 7, the plug body 122 is turned until the alignment key 76 is engaged by the flared opening 170. The plug body and receptacle shell are pushed together axially, while being slightly rotated on axis to enable the alignment key 76 to traverse into the narrow portion of the key way 128. The alignment of the FIG. 7 receptacle in the FIG. 12 plug assembly by way of the key 76 and key way 128 aligns the probes in the plug assembly with the ports in the receptacle assembly, so that each probe in the plug assembly is mated with a respective socket in the receptacle assembly. Further, the alignment provided by the key 76 and keyway 128 orients the probes in the plug assembly with the end cap holes, so that each probe is initially aligned with a contact hole for being received into a respective ed seal port.

The plug body 122 is assembled to a plug body locking sleeve 164 by means of a snap ring 162 which holds the rear lip 161 of the sleeve 164 between itself and a shoulder 165 in the plug body 122. The snap ring 162 is retained in an annular groove 160 formed on the rear portion of the plug body 122. Mating threads 166 are provided on the front inner surface of the locking sleeve 164, while the difference in diameters between the bore of the locking sleeve 164 and the forward extension of the plug body 122 provide for a small space 168 between the sleeve 164 and the body 122.

Figure 13:
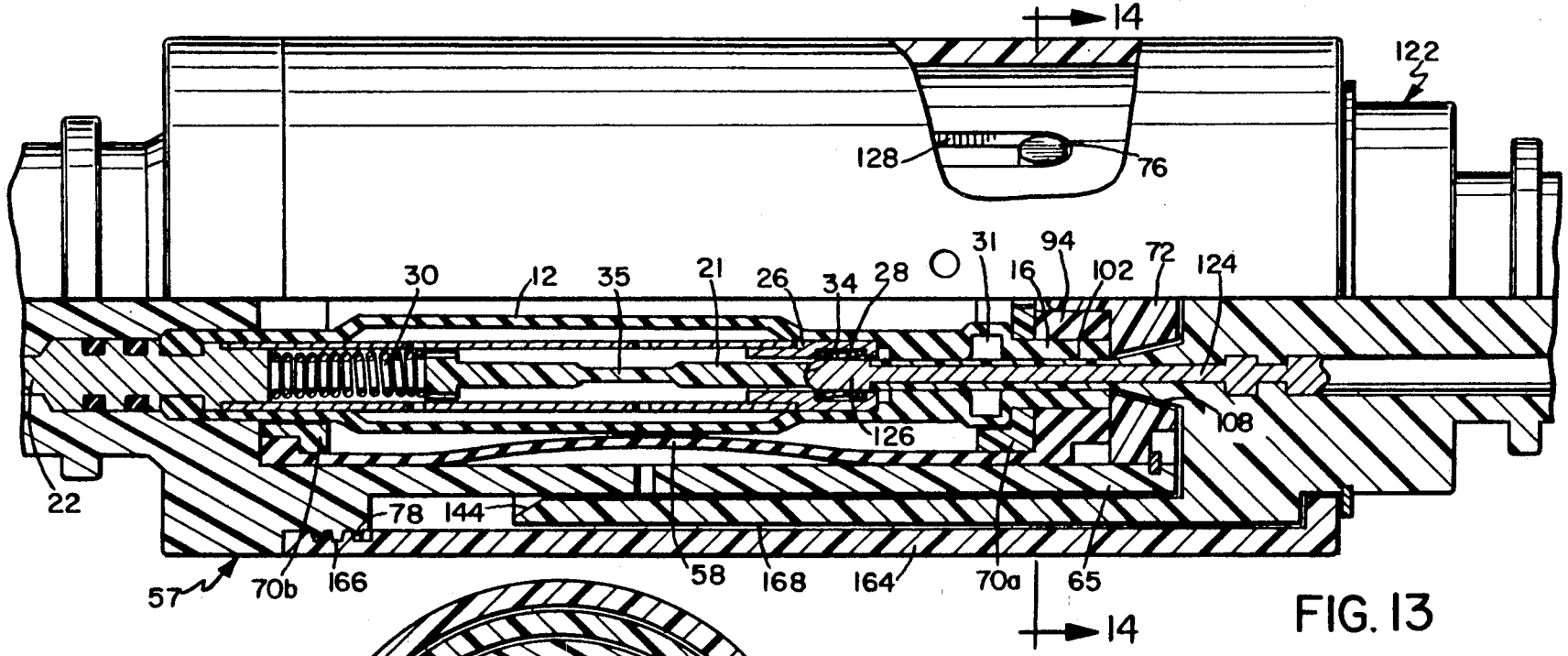
FIG. 13 is a side elevation view, in partial section, of the connected plug and receptacle units.
Figure 14:
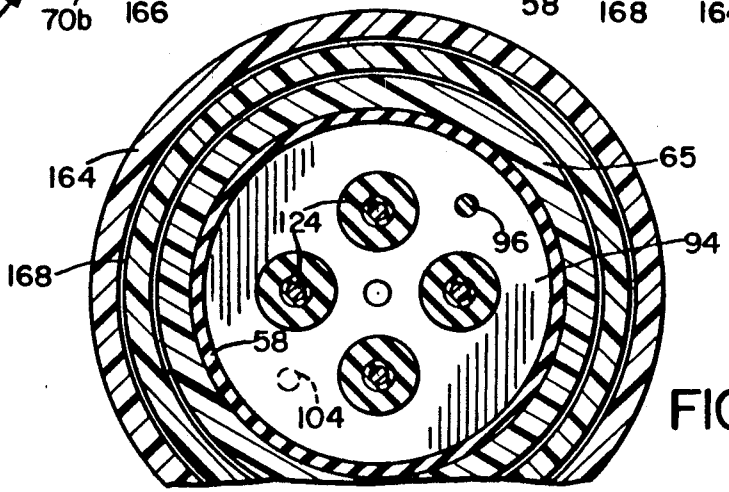
FIG. 14 is a sectional view taken along line 14—14 of FIG. 13.

The connection between the receptacle of FIG. 7 and the plug assembly of FIG. 12 is illustrated in FIGS. 13 and 14. As described above, the alignment key 76 is engaged by the keyway 128 to provide an initial alignment between the probes in the plug and the ports in the receptacle. The plug and receptacle are pushed together, with the threads 166 of the plug assembly engaging the threads 78 of the receptacle to retain the two connector halves in a mated operative engagement. As the two halves are brought together, each of the four probes in the plug assembly is aligned with and mated to a respective one of the four electrical socket assemblies. Since the manner of engagement between probe and socket is the same for each of the four probe/socket pairs, one description is given for the engagement of the probe tip 126 with the contact ring 28 in the socket assembly 10. As the connector halves are brought together, the probe tip 126 contacts the tapered surface 108 and is guided by it into contact with the concave recessed face 34 of the stopper end 21. The probe tip 126 pushes through the entry lip seal 16 of the socket assembly 10. Eventually, when the two connector halves are fully seated, the probe tip 126 has traveled into engagement with the connector ring or band 28, pushing the stopper end 21 into its retracted position inside the electrical socket assembly 10. Electrical conductivity is thereby established from the conductive element 124 through the tip 126, the ring 28, forward piece 26, tube 24, and end piece 22. The spring 30 is fully compressed. When the two connector halves are demated, the probe tip 126 is withdrawn from the interior of the socket out through the port 106, while the stopper tip 21 is urged by the spring 30 back out into the hole in end seal 16.

Figure 15:
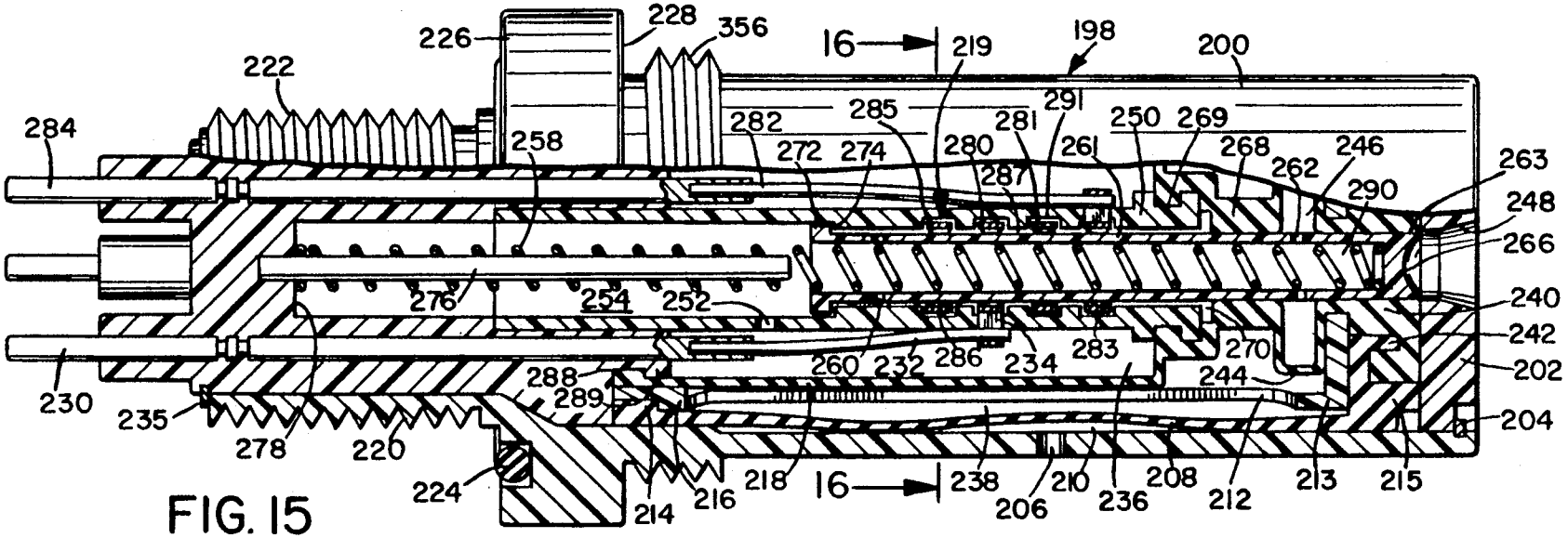
FIG. 15 is a view similar to FIG. 7, illustrating an alternative single socket, multiple connector arrangement.
Figure 16:
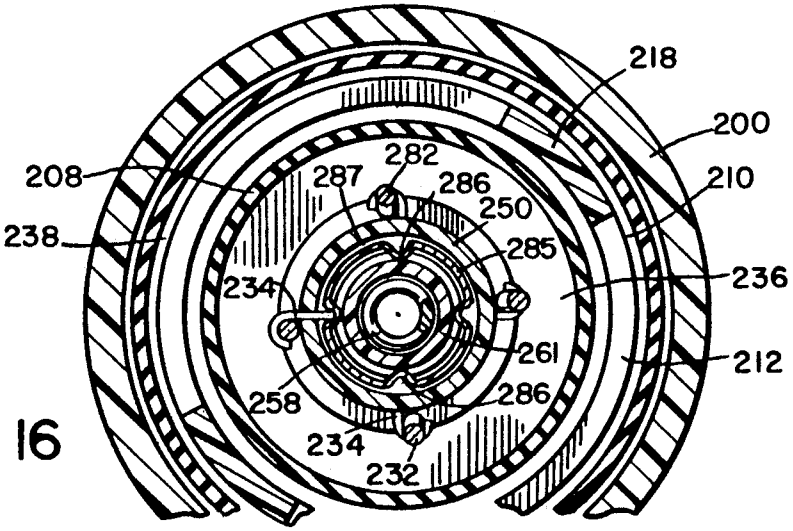
FIG. 16 is an enlarged sectional view taken on line 16—16 of FIG. 15.
Figure 19:
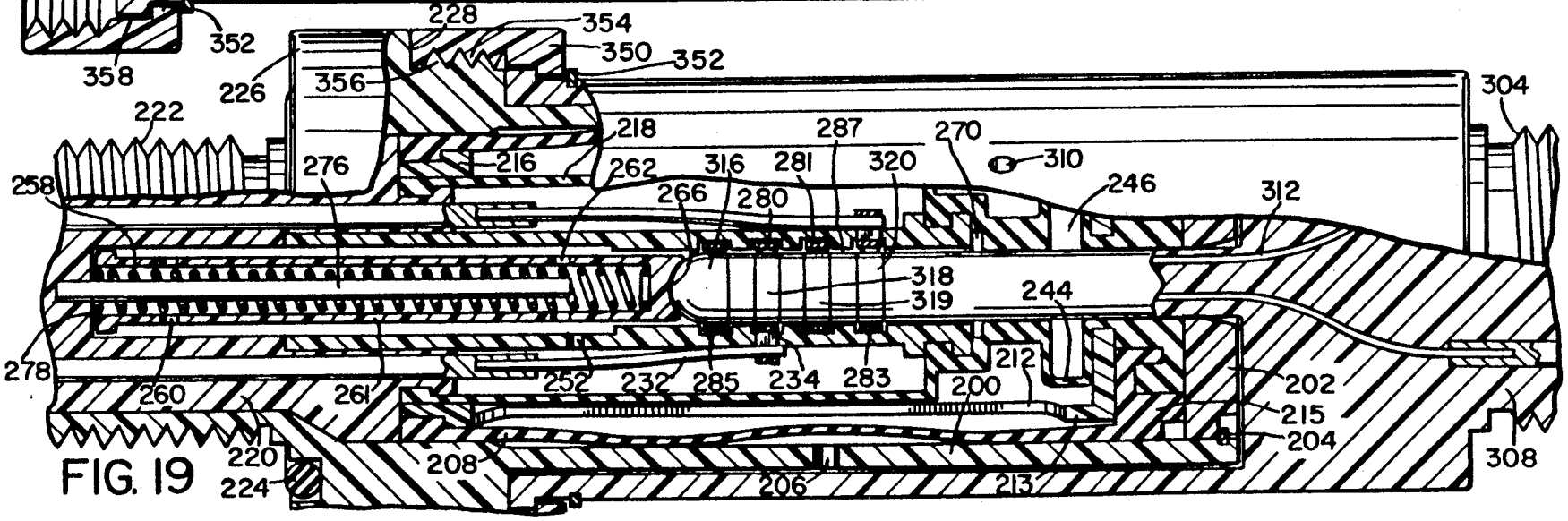
FIG. 19 illustrates the single plug and socket elements connected.

In other embodiments of the invention, see FIGS. 15, 16 and 19, the underwater electrical connector provides a variation in the construction and operation of the stopper, the fluid communication between the dielectric fluid bath chambers, and also provides multiple electrical circuit connections through a single probe and socket connection. While these embodiments are disclosed in a single, multiple circuit connector form, it is to be understood that this connector, can also be used for a single electrical circuit connection, and can be (in either its multiple electric circuit connection or its single electric circuit connection) employed in multiple socket and probe electrical connections as described in the embodiment of FIGS. 1 through 14.

The underwater electrical socket 198 has an outer housing 200 made of any suitable high strength material, With an end cap 202 on the front end and a non-conductor base 220 at the other end, which together form an internal cavity that contains a flexible chamber 218 that encloses electrical receptacles 219.

The base 220 is fitted inside of the housing 200 and is held in position by a circular lock means 235. Positioned in base 220 are a plurality of electrical conductors, such as conductors 230 and 284, that in turn are connected to respective conductor wires 232 and 282. Each of wires 232 and 282 are connected through intermediate, socket contact solder tubes, for example tube 234 that in turn are connected to ring electrical receptacles, such as receptacle 280.

Positioned in a cylindrical recess in base 220 is the socket contact housing tube 250, that is a dielectric member having internal, circumferentially spaced recesses 291 for receiving the respective, ring receptacles 280. The socket contact tube 250, which may be made of a suitable plastic, forms a passageway for movement of the stopper 261 and the electrical probe 314 , that makes electrical contact with the respective receptacle contact rings 280.

A movable stopper 261, that may be made of plastic or other suitable materials, is slidably positioned in the bore of the socket contact tube 250. One end of said stopper 261 has an enlarged shoulder 272, that abutts against an internal shoulder 274 of the socket contact tube 250 to limit the forward movement of the stopper.

A flexible chamber comprising an inner bladder 218, that may be made of natural or synthetic rubber, is connected at one end by an enlarged end band 288 that fits over and against the rim shoulder 289 on the base member 220, and at the other end an end seal 240 forms an inwardly contracting sealable opening 263 to the chamber 218. A rigid frame member or inner bladder support 212, which has the construction of frame 70 in FIG. 10, provides support for the inner bladder 218 and an outer bladder 208. The end 288 of the flexible chamber 218 is retained in place by the combination of shoulder 289 and the inner diameter of support 212 and end 214 of the outer flexible chamber or bladder 208 is retained by shoulder 216 and sealed against end 216 and the inner bore of the outer housing 200. Bladders 218 and 208 are secured together by compressed retention through innerlocking shoulders of the outer housing 200 and shoulder 289 of the base member 220. The forward end 240 of bladder 218 and the forward end 213 of bladder support member 212 and the forward end 215 of the outer bladder 208 are also secured in an innerlocking, innerconnecting sealed connection. End cap 202 presses against bladder ends 240 and 215 to further maintain the connection, which end cap 202 is in position locked by ring lock 204.

The end seal 240 of the flexible chamber 218 provides an opening 263 to the electrical receptacles 280, which opening is closed by the forward end 266 of stopper 261. Stopper 261 is a cylinder with one end open for receiving a spiral spring 258 that extends through the socket contact tube 261 and abutts against the end wall 278 of the chamber end 254. Spring 258 biases the stopper 261 to the forward position for sealing the constricted opening 263. A rod 276 is secured in end wall 278. The spiral spring 258 is mounted on rod 276, to stabilize the spring in its extended movement.

The bladder 218 is formed to provide a first chamber 244 that is filled with dielectric fluid to provide a first dielectric bath chamber 246. The bladder 218 also has formed therein, a wiper 268 that exerts resilient constrictive force circumferentially on the stopper 261, wiping the stopper in its movement through the cylindrical passage through the wiper 268. The bladder 218 is connected to the forward end of the socket contact tube 250 with an innerlocking connection 269, which supports and holds the bladder in position. This connection forms a recess or chamber 270, that with the space 287 between the internal surface of the socket contact tube 250 and the stopper 261, provides second and third dielectric bath chambers in which the stopper 261 is positioned and moves.

A suitable dielectric fluid is inserted into volumes 246, 254 and 236 and in the hollow volume 290 of the stopper 261, and the fluid moves through holes 262 to the first dielectric bath chamber 246. It may thus be understood, that all of the respective bath chambers and volumes within the flexible chamber or bladder 218 are filled with dielectric fluid and all of said openings are fluid innerconnecting.

The volume 210 outside the second fluid-filled flexible chamber 208 has the pressure of sea water through opening 206. This equalizes the pressure of the dielectric fluid in the internal volume of the second flexible member 208 and the pressure of the dielectric fluid in volume 236 of the inner flexible chamber 218 to the pressure of the outer environment.

Figure 18:
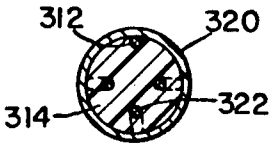
FIG. 18 is an enlarged sectional view taken on line 18—18 of FIG. 17.
Figure 17:
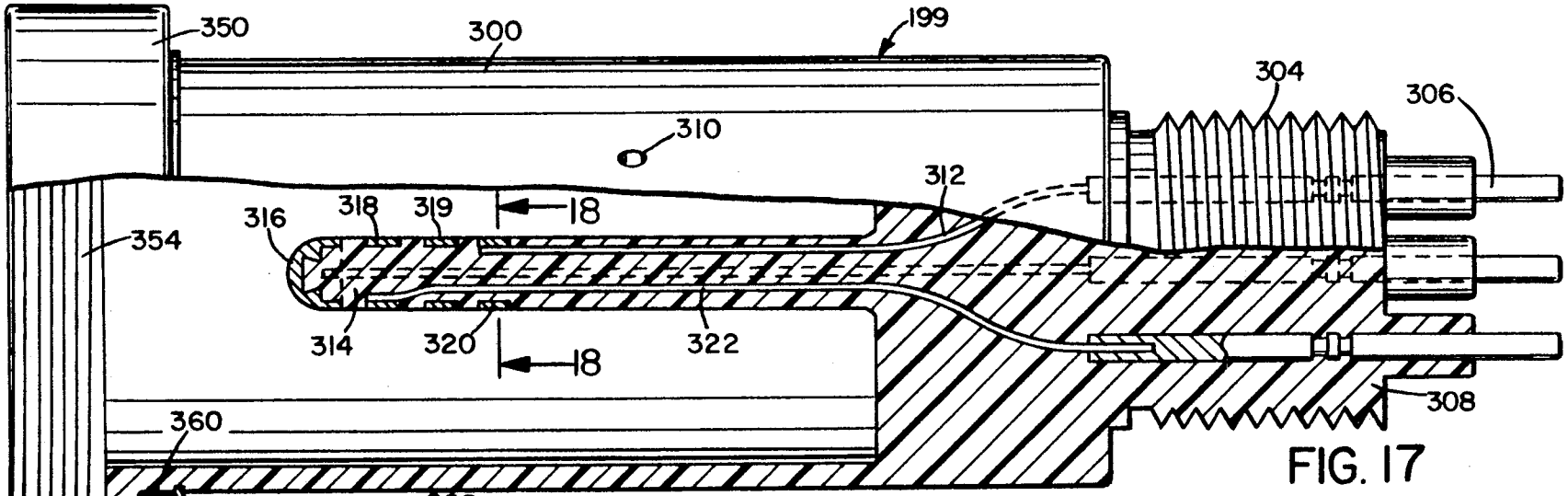
FIG. 17 is a view similar to FIG. 12, but with a single plug, multiple connector.

A probe member having multiple electrical contacts for making electrical connection with the underwater electrical socket of FIG. 15, comprises a single probe 314, see FIG. 17, positioned in housing 300, having a front connector ring 350. The probe 314 is made of plastic or other suitable dielectric material, in which are embedded electrical conductor lines 312 that pass through base member 308 to suitable, insulated electrical connectors 306. See FIG. 18. Threads 304 make connection with a cable having internal line conductors that in turn make connections with the electrical circuit to input conductors 306.

The respective electrical conductors 312 are connected to individual, spaced, ring contacts 318, 319 and 320, and to end contact 316. The end contact of the probe tip has a curved shape for fitting against the mating concave surface in the end 266 of the stopper 261.

In the operation of making a mated connection, the probe 314 is inserted through the conical opening 248 of end cap 202, see FIG. 19, and the outer housing 300 is slipped over the inner housing 200 with coupling 350 engaging the threads 356. The coupling 350 is retained by retainer 352 and when completely tightened, abutts against the side 228 of rim 226. In this movement, probe 314 is aligned with the opening 248 which conical surface directs the probe end 316 into contact with end 266 of stopper 261. This movement forces stopper 261 to retract against spring 258, which moves end 266 to the position shown in FIG. 19. In this position, the respective electrical contacts 316, 318, 319 and 320 make electrical contact with the respective ring receptacles 285, 280, 281 and 283 of the electrical socket, making the electrical connection of multiple electrical circuits through one probe-receptacle mating.

The insertion of the probe 314 through the constricted opening 263 moves the end 266 of the stopper 261 back through the first dielectric bath chamber 246, through the wiping passageway of wiper 268, and then into the second and third bath chambers 254 and 270, which function to reduce the entry of sea water or impurities through the sealable opening in the process of making the electrical connection.

The electrical contacts in the probe 314 have cylindrical upper surfaces that match the surface of the enclosing plastic, providing a uniform interior of the assembly. This smooth surface does not have ridges, or recesses or raised edges that damage or scratch the inner surface 263 of the end seal 240, or so damage the internal wiping surface of the wiper 268. When the probe electrical contacts, for example contact 319, are positioned in the receptacle, electrical contact is made with the individual receptacle rings by means of the projecting dimple shaped indentations 286. These indentations 286, see FIG. 16, project inwardly from the base receptacle ring 219 to contact the smooth surface of the probe contacts. The projections 268 have a round and smooth surface, that does not mar or damage the surface of the probe 214, and yet makes assured electrical contact with the respective contacts on the probe. This further permits spacing between the probe 314 and the inner surface of the socket contact tube 250, that reduces possible damage to the probe tip, which damage could result in damaging the internal surface 263 of the seal 240.

Because of the multiple connectors, the stopper 261 has a relatively long movement and accordingly requires space to position and stabilize the coil spring 258. This is accomplished by coiling the spring in the space around rod 226 and in the inner volume of the socket contact tube.

The embodiment illustrated in FIGS. 15 through 19, provides a multiple electrical circuit contact means through an electrical connection between a single probe and a single electrical socket. However, it is to be understood that this embodiment may be employed in the embodiment utilizing a fluid filled bladder containing a plurality of sockets, where the fluid filled bladder is sealed around each of the sealable openings of each of the plurality of sockets.

Obviously many variations of the inventions are possible in light of these teachings which, when employed, will not deviate from the scope of the appended claims.

I claim:

1. An underwater electrical socket, comprising:

a flexible chamber for enclosing an electrical receptacle in dielectric fluid and having a sealable opening at one end;

said flexible chamber having first and second, fluid interconnecting dielectric bath chambers with an inner wiper positioned therebetween;

a dielectric stopper in said chamber for exposing the electrical receptacle to electrical contact being slidably disposed in said chamber for moving in said first and second dielectric bath chambers and being wiped by said inner wiper, said inner wiper having a cylindrical passageway, said dielectric stopper having along its length a first portion with a first diameter and a second portion with a second, smaller diameter; and said first diameter portion being normally positioned in said sealable opening and said second smaller diameter portion being positioned in said inner wiper passageway and partially in said first and second dielectric bath chambers, providing fluid interconnection between said first and second bath chambers.

2. An underwater electrical socket, comprising:

a flexible chamber for enclosing an electrical receptacle in dielectric fluid and having a sealable opening at one end;

said flexible chamber having first and second, fluid interconnecting dielectric bath chambers with an inner wiper positioned therebetween;

a dielectric stopper in said chamber for exposing the electrical receptacle to electrical contact being slidably disposed in said chamber for moving in said first and second dielectric bath chambers and being wiped by said inner wiper, said dielectric stopper having a longitudinal length that extends in said first and second bath chambers, said longitudinal length comprising a first portion with a first diameter, a second portion with a second smaller diameter, and a third portion having a diameter comparable with said first diameter;

said first diameter portion being normally positioned in said sealable opening, said second diameter portion being normally positioned in said inner wiper and in portions of both said first and second bath chambers, and said third diameter portion being positioned in said second bath chamber; and said inner wiper having a passageway larger than said second diameter, permitting fluid flow between said first and second chambers.

3. An underwater electrical socket as claimed in claim 2 in which:

the diameter of the opening of said inner wiper being smaller than the outer diameter of the first portion of said stopper, circumferentially wiping said first portion in movement through said passageway.

4. An underwater electrical socket as claimed in claim 3 in which:

said electrical receptacle being positioned in said second bath chamber, and means for biasing said dielectric stopper from a retracted position in which said first portion is in said second bath chamber, in a position exposing said electrical receptacle to electrical contact, to an extended position where said first portion extends into and seals said sealable opening.

* * * * *